United States Patent [19]

Nagahashi et al.

[11] Patent Number: 5,057,066

[45] Date of Patent: Oct. 15, 1991

[54] MAGAZINE AND METHOD OF FEEDING ARTICLES

[75] Inventors: Toshio Nagahashi; Hisafumi Kobayashi; Minoru Sato, all of Chiba, Japan

[73] Assignee: Tokyo Automatic Machinery Works, Ltd., Tokyo, Japan

[21] Appl. No.: 292,422

[22] Filed: Dec. 30, 1988

[30] Foreign Application Priority Data

Apr. 28, 1988 [JP] Japan ..... 63-107897

[51] Int. Cl.[5] ..... B65H 3/08; B65H 3/34

[52] U.S. Cl. ..... 493/317; 271/99; 271/104; 414/798.9; 493/122

[58] Field of Search ..... 493/122, 123, 126, 315, 493/316, 317, 318, 124, 125, 127; 271/5, 99, 104, 265, 198, 314, 166; 414/798.1, 798.9

[56] References Cited

U.S. PATENT DOCUMENTS

| | | | |
|---|---|---|---|
| 1,739,153 | 12/1929 | Laxo et al. | 271/166 |
| 2,699,712 | 1/1955 | Meyer-Jagenberg | 493/316 |
| 3,858,490 | 1/1975 | Heisler | 493/316 |
| 4,157,058 | 6/1979 | Vogel | 493/124 |
| 4,596,545 | 6/1986 | Greewell | 493/318 |

*Primary Examiner*—James G. Smith
*Assistant Examiner*—Jack W. Lavinder
*Attorney, Agent, or Firm*—Sandler, Greenblum, & Bernstein

[57] ABSTRACT

A magazine for holding a plurality of articles, such as cartons, which are to be singularly withdrawn at a downstream end, and a method of feeding articles. The magazine includes guides, spaced apart by a distance greater than the width of the cartons in their folded condition, thereby creating a gap between an inner guide surface and one of the edges of the cartons. A pair of stoppers project from the inner guide surfaces and are spaced apart by a distance less than the width of the cartons, to thereby hold the most downstream carton in a position to facilitate its withdrawal at the discharge end of the magazine. A feed roller projects from one inner guide surface toward the other inner guide surface upstream of the discharge end. At least one carton is engaged between the roller and the other inner guide surface to isolate a predetermined number of folded cartons downstream of the feed roller from a second predetermined quantity of folded cartons upstream of the feed roller. Further, due to the engagement of the edges of the most downstream carton and the stoppers, as the carton is withdrawn from the magazine, the carton is more fully opened to thereby facilitate its subsequent complete opening. A supply conveyor is provided upstream of the guide surfaces. The supply conveyor and the feed roller can be driven synchronously in response to the sensing of a reduction in the quantity of cartons in the downstream portion of the magazine.

38 Claims, 3 Drawing Sheets

MAGAZINE AND METHOD OF FEEDING ARTICLES

BACKGROUND OF THE INVENTION

1. Field of the Invention

The present invention relates to a magazine for holding a large number of substantially flat articles, such as flatwise folded cartons in particular, in a stacked condition between a pair of substantially parallel guides. More particularly, the invention is directed to a magazine for facilitating the release and partial opening of such cartons successively from downstream end portions of a pair of guides, after which the cartons can be more fully opened using a mechanism including, e.g., a suction cup.

2. Description of Background and Pertinent Information

According to a conventional magazine of this type, for example, as disclosed in Japanese Laid-Open Patent Application No. 26833/84, a pair of inclined guides are spaced from each other by a distance less than a vertical width of each folded carton to form a restriction, thereby lessening the effect of pressure caused by the folded cartons on the upstream side from being applied to the cartons on the downstream side. A small detent or a flapengaging pin is provided at a discharge end portion to prevent sudden discharge of the cartons. Further, a horizontal conveyor for mounting a large quantity of cartons thereon in an upright condition is disposed on the upstream side of the lower guide, which conveyor is driven upon detection of a positional change of the upper edges of the upright cartons as the cartons are drawn out, to supply cartons intermittently, in a quantity matching the quantity of the drawn-out cartons. By this construction the resistance of each carton being drawn out is intended to be minimized to permit cartons to be drawn out relatively easily.

PROBLEMS SOLVED BY THE INVENTION

The conventional magazine described above is constructed so that the cartons contained therein undergo approximately equal pressures from the upstream-located cartons and both upper and lower edges thereof come into engagement with the above-mentioned restriction created by the inclined guides, allowing the cartons to slide downstream successively each time a carton located at the downstream end is withdrawn. However, since such magazine is intended to hold not only flatwise folded cartons but, additionally, also flat base papers and folded leaflets, the problem arises that the specific and unique characteristics of cartons are not accommodated, resulting in relatively unsatisfactory handling of cartons.

The present invention has been effected, in particular, in consideration of the properties peculiar to folded cartons.

A folded carton tends to open by virtue of the stiffness of the base paper from which it is made. The degree of expansion of a carton varies depending upon the difference in the quality or dimensional accuracy of the base paper, or upon the difference int he storage time in a folded state. But such folded cartons tend to open at all times. Consequently, the aforementioned guide restriction does not have the desired effect on all of the cartons; the pressure induced thereby tends to be imposed on the carton located at the downstream end; and the necessity arises of having to take some countermeasure against a sudden discharge of the cartons at the discharge end of the magazine.

In order to overcome the problems mentioned above, it is important to make the vertical width of each carton relatively uniform. Further, it is necessary to limit the quality of paper to a particular type and to improve the dimensional accuracy or storage standard. However, these solutions present the problem of increased material costs.

The aforementioned property of the folded cartons tending to open creates an expansive elasticity in the stacked direction of the cartons within the magazine. However, since such elasticity itself is not a relatively large force, this property is utilized effectively by reducing the urging force or gravity of the succeeding cartons and the frictional resistance of the flow of cartons. That is, it is important that the carton being withdrawn convert its vertical compression into an opening action in which it tends to expand in the stacked direction at the discharge end.

In the above-mentioned conventional magazine, an additional pressure from the upstream side is applied by a certain extent to the cartons located at the downstream end. Conversely, when cartons are pushed back from the downstream to the upstream side by a mechanism assisting in their respective release from the magazine, the cartons are further compressed so greatly that it is almost impossible to push the cartons back by such mechanism. Further, it is difficult to open the cartons because they are drawn out in a compressed condition.

In the foregoing conventional magazine, moreover, cartons in a quantity corresponding to the quantity of the cartons withdrawn from the downstream end are replenished by driving the horizontal conveyor upon detection of a degree of tilting of the cartons which are carried upright on the horizontal conveyor. So where the row of the cartons on the horizontal conveyor for detecting the tilting degree of the cartons is not long, it becomes difficult to effect the detection, resulting in a deteriorated capability for control and the necessity of a wider mounting space for the magazine.

SUMMARY OF THE INVENTION

It is an object of the present invention to overcome the problems in the prior art by providing a magazine for holding a plurality of stacked, flatwise folded cartons which are to be singularly withdrawn therefrom at a downstream end thereof, the magazine including a first guide and a second guide each having a respective inner surface between which the stacked cartons are held, the first guide and the second guide being spaced apart by a distance greater than a given distance between a pair of edges of respective cartons in their flatwise folded condition, thereby creating a gap between one of the first and second guides and one of the pair of edges of respective cartons; a first stopper projecting from the first inner guide surface and a second stopper projecting from the second inner guide surface, the first stopper and the second stopper being spaced apart by a distance less than the given distance between the pair of edges of the respective cartons; at least one feed roller, at least a portion of which projects from the second inner guide surface toward the first inner guide surface and is spaced from the second inner guide surface by a distance less than the given distance between the pair of edges of the respective cartons; means for driving the feed roller for rotation toward the downstream end of the magazine; and a sensor operatively associated with the driving means for controlling the rotation of the feed roller as a function of the quantity of cartons positioned downstream of the feed roller.

According to a further aspect of the invention, each of the stoppers has a curved or inclined inner end face such that a spacing is defined between the inner end face of the first stopper and the inner end face of the second stopper which gradually decreases toward the downstream end of the magazine.

A further aspect of the invention includes a supply conveyor having a conveyance portion disposed upstream of the second guide for supplying a plurality of cartons, wherein the conveyance portion is adapted to be driven in synchronism with the feed roller.

According to a further aspect of the invention, the feed roller is mounted for selective adjustment toward and away from the downstream end of the magazine.

A further object of the invention is to provide an apparatus for storing articles in a supply and for facilitating withdrawal of the articles from the supply which includes:

(a) means for guiding the articles for movement from an upstream position to a downstream position;

(b) a discharge end located at the most downstream portion of the guiding means from which the articles can be withdrawn from the supply;

(c) means separate from said guiding means and located along the guiding means, upstream of the discharge end for substantially isolating a first predetermined number of the articles in the supply from the pressure created by a second predetermined number of the articles positioned upstream of the firsts predetermined number of the articles.

According to a further aspect of the invention, the guiding means includes at least two substantially parallel guide surfaces. The guide surfaces can both be inclined at an angle of, e.g. 30 degrees for horizontal.

According to a further aspect of the invention the guide surfaces include a lower guide surface upon which a plurality of the articles within the supply are to be supported, and an upper guide surface adapted to be spaced from the lower guide surface at a distance greater than a predetermined width dimension of one of the articles.

According to a still further aspect of the invention, mean for isolating includes means for temporarily engaging at least one of the articles in the supply. The means for isolating is also adapted to engage and advance at least one of the articles in the supply towards the discharge end of the supply and is, preferably, an intermittently driven roller.

According to a still further aspect of the invention, the means for guiding includes at least two guide surfaces, wherein the roller is positioned proximate one of the guide surfaces and at least partially projects therefrom toward a second of the guide surfaces so as to be spaced therefrom by a distance less than a predetermined width dimension of one of the articles.

According to a still further aspect of the invention, the roller is mounted for selective adjustment toward and away from the discharge end of the supply.

According to a still further aspect of the invention, a supply conveyor is positioned proximate an upstream portion of one guide surface for supplying the articles thereto and having a reach adjacent the upstream portion of the one guide surfaces, and which is inclined substantially at said predetermined angle.

According to a still further aspect of the invention, a first predetermined number of articles extend from a position adjacent the discharge end of the supply, and the apparatus further includes means for controlling the value of the first predetermined number of articles, including means for sensing a condition indicative of the value of the first predetermined number of articles and means for driving the means for intermittently feeding the articles. The condition sensed by the means for sensing is a function of a space between the upper guide surface and at least one article not engaged by the means for isolating the first predetermined number of articles.

According to a still further aspect of the invention, the articles are flatwise folded cartons and the means for isolating a first predetermined number of the articles further includes means for at least partially opening the folded cartons, which can include a first projection proximate the discharge end, projecting from one of the guide surfaces, and a second projection proximate the discharge end, projecting from a second of the guide surfaces. The first projection and the second projection are spaced apart by a distance less that a width dimension of at least one of the cartons such that, upon engagement of a first portion of a respective carton at the discharge end by a withdrawal mechanism for withdrawing the respective carton from the supply, second and third opposed portions of the carton engage respective portions of the first and second projections to thereby enable the respective carton to be at least partially opened. A withdrawal mechanism, such as a vacuum gripper, engages the first portion of a respective carton.

According to a still further aspect of the invention, the first and second projections include respective surfaces which converge toward the discharge end of the apparatus.

According to a still further aspect of the invention, the means for isolating includes means for advancing the articles along the means for guiding toward the discharge end, wherein the apparatus further includes a supply conveyor having a reach upstream from and adjacent to the means for guiding, and means for synchronously driving the supply conveyor and the means for advancing the articles. The means for advancing can include at least one feed roller, and the supply conveyor can include least one endless conveyor belt. The endless conveyor belt can include a driven shaft upon which the feed roller is mounted for driven engagement thereby.

It is a further object of the invention to provide a method of feeding flatwise folded cartons each having a predetermined width through a magazine and of facilitating withdrawal of the cartons from the magazine including:

(a) creating a supply of stacked cartons within the magazine;

(b) guiding the folded cartons within the magazine between an upstream position to a downstream end by means of at least a pair of substantially parallel guide surfaces spaced apart by a distance greater than the predetermined width of the cartons to thereby define a gap between a first edge of each of the stacked cartons and one of the guide surfaces; and (c) engaging a respective second edge of at least one of the cartons within the magazine and moving the cartons toward and against a second of the guide surfaces to thereby isolate an upstream quantity of cartons from a downstream quantity of cartons.

The method further includes the steps of sensing a reduction in the second downstream quantity of cartons; feeding the cartons previously engaged and pushed, and feeding an additional quantity of cartons maintained in the magazine toward the downstream end; and engaging a respective second edge of at least a second one of the cartons within the magazine and moving the second one of the cartons toward and against the second of the guide surfaces to thereby isolate a second upstream quantity of cartons from a second downstream quantity of cartons to thereby substantially maintain a predetermined downstream quantity value of stacked cartons proximate the downstream end.

The method further includes the steps of restricting downstream movement of at least a first edge and an opposed second edge of the most downstream carton which is proximate the downstream end of the magazine; and withdrawing the most downstream carton by engaging a portion of the most downstream carton between the first edge and the second edge to thereby at least partially open the most downstream carton as it is withdrawn from the magazine.

DESCRIPTION OF PREFERRED EMBODIMENTS

Figure 1:
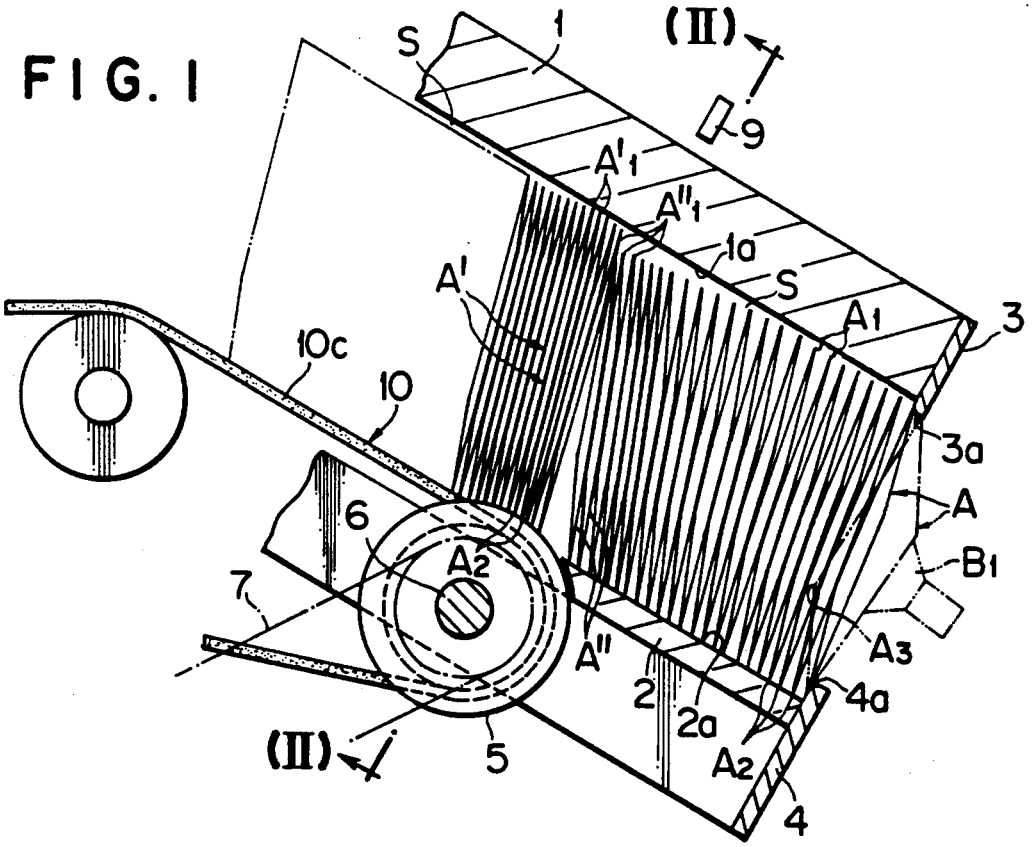
FIG. 1 is a longitudinal sectional view, partially illustrating a magazine according to an embodiment of the present invention.

The present invention is described herein as relating in particular to a magazine for flatwise folded cartons. However, it is contemplated that other articles can be supplied and stored by the apparatus described and claimed herein.

The present invention has been created in view of the conventional apparatus and it is a first object of the present invention to eliminate the intra-magazine frictional resistance of both upper and lower edges of the cartons, thereby permitting the cartons to move freely and, at the same time, completely preventing jamming and dropping of the cartons. Still further, in this first object, the invention is to completely eliminate the pressure from the upstream side of the apparatus with respect to the cartons located on the downstream side, thereby permitting the cartons on the downstream side to move freely.

It is a second object of the present invention to partially open a carton being withdrawn.

It is a third object of the invention to permit the replenishment of cartons without functional deterioration of the supply portion for supplying a large quantity of cartons even when the same supply portion is at a desired angle, ranging from a horizontal to a vertical position.

It is a fourth object of the invention to permit the selection of the most suitable pressure to be applied to the carton located at the downstream end according to the material, size, paper thickness, and shape of the carton, or the state and duration of storage.

The first object of the invention is characterized in that a gap is formed between the inner surface of a first, upper one of a pair of guides and one of two vertically spaced edges of each carton in a stacked condition. Inwardly projecting stoppers are attached to the downstream ends of the guides so that the spacing between the stoppers is less than the inter-edge distance of each folded carton. A feed roller is disposed in a suitable position with respect to a second, lower one of the guides so as to project inwardly from the inner surface of the guide, and so that the distance from the circumferential surface of the feed roller to the inner surface of the first guide is less than the edge-to-edge dimension of each folded carton. A sensor is provided for controlling the operation of the feed roller in accordance with a decrease in the number of cartons positioned downstream of the feed roller.

The second object of the invention is characterized in that the stoppers at the downstream ends of the paired guides have curved or inclined inner end faces formed so that the spacing therebetween becomes gradually narrower toward the downstream end.

The third object of the invention is characterized in that a conveyance portion for supplying a large quantity of cartons is disposed upstream of the second guide, the conveyance portion being adapted to operate in synchronism with the feed roller.

The fourth object of the invention is characterized in that the mounting position of the feed roller is made adjustable in the direction in which the cartons are stacked i.e., along the length of the supply channel of the magazine.

The operation of a first aspect of the invention is as follows. Both edges of the most downstream carton in the magazine are positioned and retained by both stoppers so that the carton is stopped from sliding, while upstream therefrom, both edges of a carton are brought into pressure contact with the surface of the feed roller and the inner surface of the first guide, thereby allowing the upstream carton to serve as a shutoff to prevent the upstream-side pressure from being exerted on the cartons positioned downstream of the feed roller. In this way, not only is a free elasticity of the cartons retained between the most downstream carton and the carton engaged by the feed roller, but a push-back operation for the succeeding cartons is enabled, created by the tendency of each carton to expand toward an open position in the stacked carton direction, i.e., along the feed channel of the magazine, when the carton is withdrawn by the section cup or other such device. As a result, the backward inclination of the cartons due to their tilting and the lessening of pressure of the stacked cartons is facilitated, and the cartons are drawn out successively from the downstream end of the magazine. Then, upon detection by the sensor of a decrease in the number of the cartons positioned downstream of the feed roller, the roller is operated to push the cartons upwardly into abutment with the inner surface of the upper, first guide, while thereby intermittently replenishing the sensed shortage.

According to a second aspect of the invention, when the carton positioned at the downstream end is withdrawn from between both stoppers by virtue of suction of the suction cup, e.g., both upper and lower edges of the carton are brought into sliding contact with the curved or inclined end faces of the stoppers, and are thereby compressed in a direction toward each other.

According to a third aspect of the invention, the conveyance portion for supplying a large quantity of cartons is operated in synchronism with the feed of cartons by the feed roller, whereby the same quantity of cartons as that of the cartons fed by the feed roller are replenished to the upstream side of the feed roller.

According to a fourth aspect of the invention, the feed roller is movably positioned in the carton stacked direction to thereby selectively increase or decrease the number of cartons positioned between the feed roller and the downstream end of the magazine.

A specific embodiment of the present invention will now be described with reference to the drawings.

As shown in FIG. 1, both upper and lower flat guides 1 and 2 for holding flatwise folded cartons A in a stacked condition are disposed inclinedly at an angle of about 30 degrees at which the cartons A can be easily withdrawn by a section cup $B_1$ preferably moving along a hypotrochoid path.

The upper and lower guides 1 and 2 are each constituted by a flat plate or plural plates arranged side-by-side in spaced relation in the direction of the feeding of the cartons, and have smooth inner surfaces. Lower edges $A_2$ of the cartons A are slidably placed on an inner surface 2*a* of the lower guide 2, and the upper and lower guides 1 and 2 are spaced from each other so as to form a gap S between upper edges $A_1$ of the stacked cartons A and the inner surface of the upper guide. From the downstream ends of both guides 1 and 2, upper and lower stoppers 3 and 4 project substantially perpendicularly or at an acute angle relative to the inclination angle of both guides, so that the spacing between the upper and lower stoppers 3 and 4 is less than the vertical width of the folded cartons A.

Consequently, the upper and lower edges $A_1$ and $A_2$ of the carton A positioned at the downstream end strike the upper and lower stoppers 3 and 4 and are held substantially perpendicularly or at an acute angle relative to the inclination angle of both guides 1 and 2, and cartons A are stacked and held successively on the upstream side.

The upper and lower stoppers 3 and 4 have curved inner end faces 3*a* and 4*a* respectively, or inclined inner end faces, continuous with the downstream ends of upper and lower guide inner surfaces 1*a* and 2*a*, and formed so that the spacing therebetween becomes gradually narrower toward the downstream side.

In a suitable position of the lower guide 2, more specifically at a suitable length on the upstream side of the downstream end, a feed roller 5 is disposed projecting upwardly from the inner guide surface 2*a* and adapted to rotate only toward the downstream side in the stacked direction of cartons A. The feed roller 5 is mounted so that the distance from the upper reach of the feed roller 5 to the upper guide inner surface 1*a* is less than the vertical width of the folded cartons A.

Figure 2:
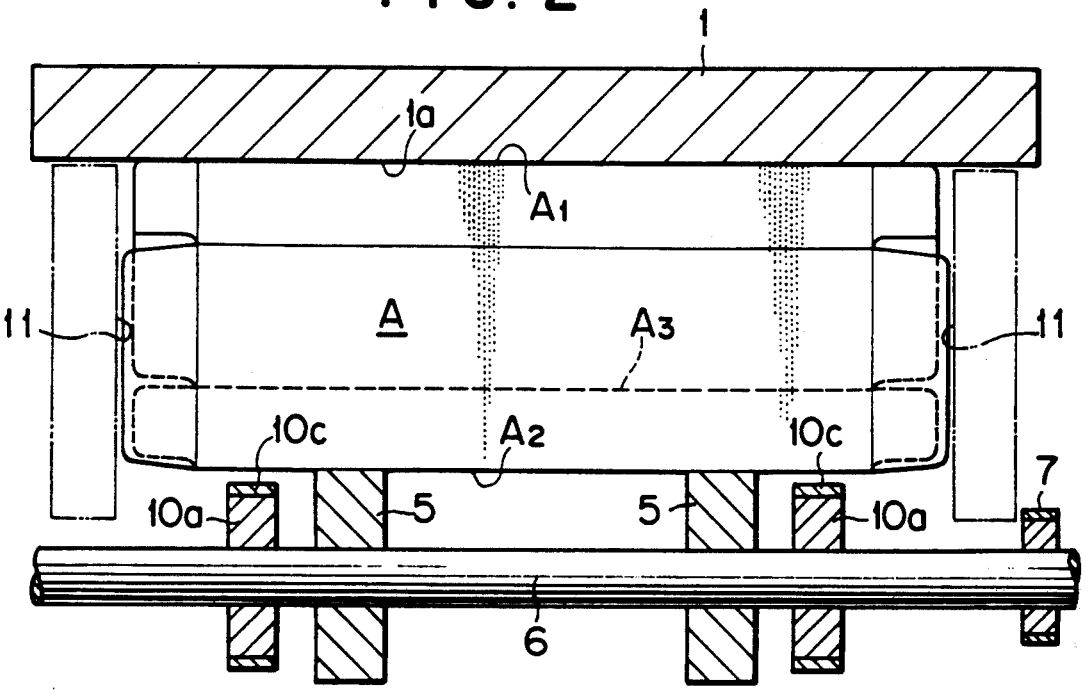
FIG. 2 is a sectional view taken along line (II)-(II) of FIG. 1.

In this embodiment as illustrated in FIG. 2, a pair of right and left feed rollers 5 are fixed in an appropriately fixed relation to each other onto a rotary shaft 6 extending substantially horizontally below the lower guide 2 in a direction substantially perpendicular to the stacked direction of the cartons A, the rotary shaft 6 being connected to a motor 8 through a transfer belt 7.

Upon rotation of the feed roller 5 with the operation of the motor 8, a carton A′ positioned upstream of the feed roller 5 is pushed upwardly while being fed toward the downstream side, resulting in that an upper edge $A_1'$ thereof abuts the upper inner guide surface 1*a* and the carton is slightly opened while its upper and lower edges $A_1'$ and $A_2'$ are held in pressure contact with the upper inner guide surface 1*a* and the feed roller 5, respectively. But the carton will not be opened to a greater extent because of a constant application of pressure to the carton A′ from the upstream side. When the feed roller 5 is stopped in this state, the carton A′ receives the pressure created by the stacked cartons on the upstream side.

The motor 8 is electrically connected to a drive controlling sensor 9 and, in accordance with a drive signal provided from the sensor 9, the motor 8 causes the feed rollers 5 to rotate faster than the carton withdrawing speed on the later-described suction cup $B_1$, or stops the rollers 5.

In this embodiment, the drive-controlling sensor 9 is a diffuse reflection type photoelectric sensor, which is disposed in an opposed relation to an upper edge $A_1''$ or a carton A″ positioned downstream of the feed rollers 5. When the upper edge $A_1''$ is in a preset height position and the quantity of reflected light corresponds to a preset quantity, the sensor 9 does not produce a drive signal to the motor 8, so that the motor remains stopped. But, when the carton A″ tilts with the carton withdrawing operation of the suction cup $B_1$ to increase the spacing from the upper edge $A_1$, and the quantity of reflected light changes, the sensor 9 judges that the quantity of cartons is less than a desired amount, and continues to provide a drive signal to the motor 8 until the quantity of reflected light returns to the preset level.

Upstream of the lower guide 2, more specifically, upstream of the feed roller 5, there is disposed a conveyance portion 10 of a supply conveyor for supplying a large quantity of cartons, which conveyance position is adapted to advance in synchronism with the rollers 5.

The conveyance portion 10 for supplying a large quantity of cartons is preferably a conveyor belt substantially contiguous with the inner surface 2*a* of the lower guide 2. In this embodiment, a pair of right and left driving pulleys 10*a* are mounted on the rotary shaft 6, and a pair of conveyor belts 10*c* are entrained in the stacked direction of cartons A about the driving pulleys 10*a* and, also, about a pair of driven pulleys 10*b* disposed upstream of the driving pulleys. A large quantity of cartons A are placed in a stacked condition on the conveyor belts 10*c*, which belts are driven simultaneously with rotation of the feed rollers 5, whereby the cartons are replenished to the upstream side of the feed rollers.

Figure 3:
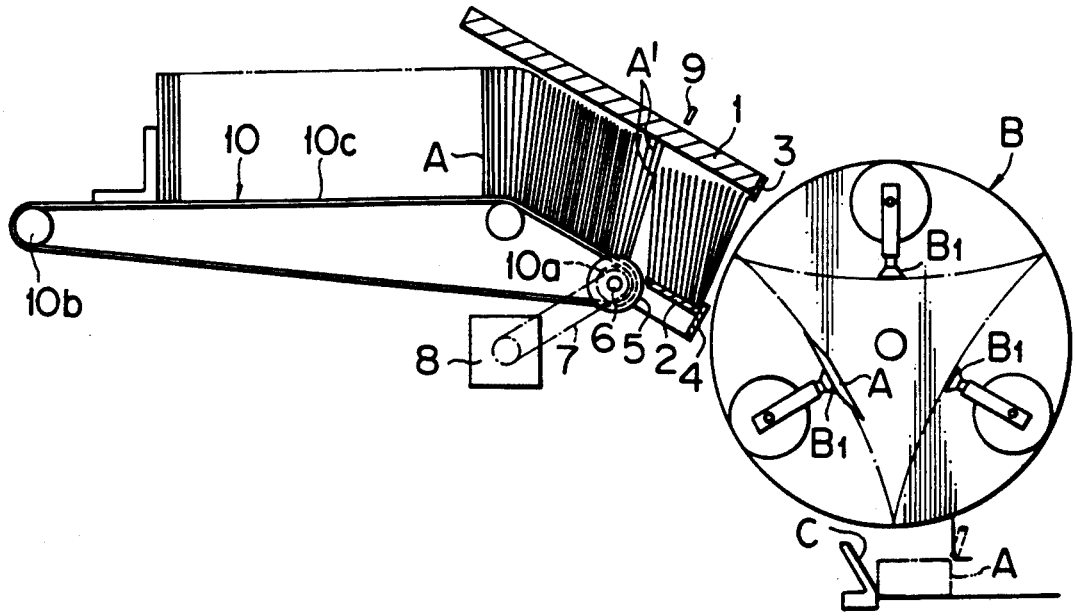
FIG. 3 is a side view, in partial longitudinal section, showing the whole of the magazine, including a conveyance portion for supplying a large quantity of cartons, installed in a substantially horizontal condition.
Figure 4:
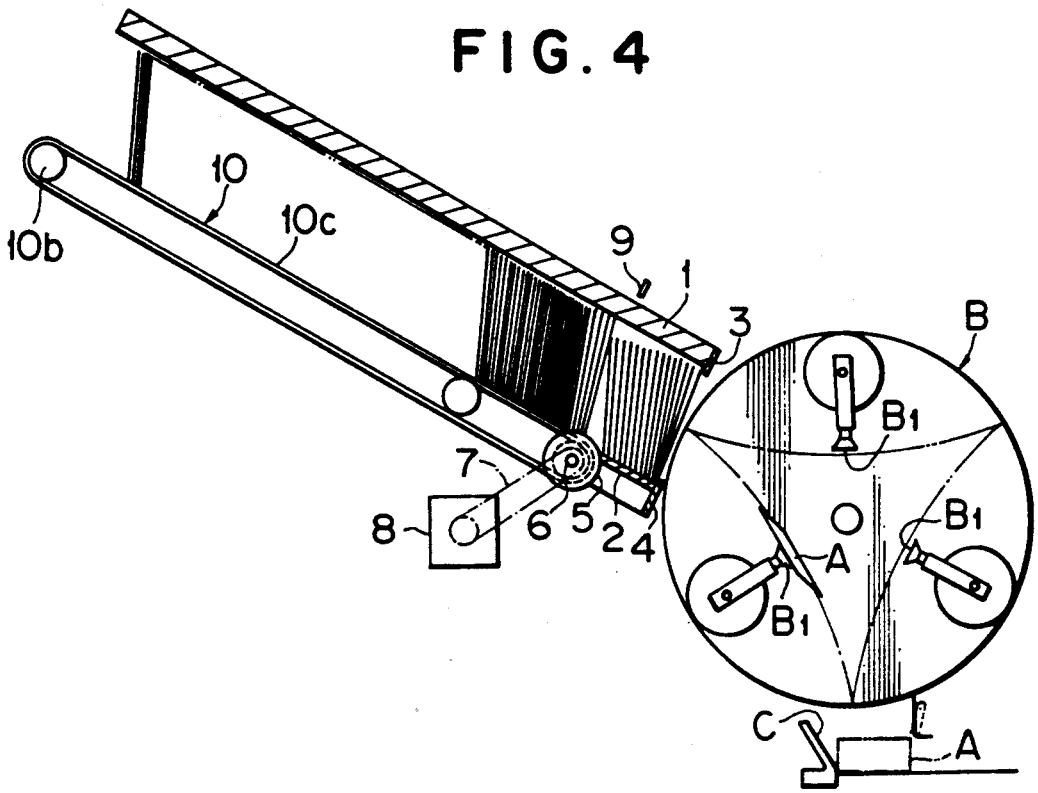
FIG. 4 is a view similar to that of FIG. 3, showing the same conveyance portion in an inclined condition.

The carton carrying surfaces of the conveyor belts 10*c* are adjustable in position from substantially horizontal shown in FIG. 3, to a position inclined downwardly from upstream to downstream, shown in FIG. 4, by vertically changing the position of the driven pulleys 10*b* located at the upper end of the supply conveyor.

Although the driving pulleys 10*a* are mounted coaxially with the feed rollers 5 on the rotary shaft 6, the apparatus of the invention is not limited to such an arrangement. The driving pulleys 10*a* may be supported by a shaft separate from the rotary shaft 6 and driven directly from the motor 8 through transfer belts. In this case, plural conveyor belts 10*c* of a relatively small width or, alternatively, a single conveyor belt of a relatively large width may be utilized.

Further, on the downstream side of the upper and lower stoppers 3 and 4, there is disposed a rotatable transfer mechanism B which preferably includes three planetary gear trains meshing with a fixed gear, and section cups $B_1$ connected to outer-end gears of the planetary gear trains. This mechanism is shown schematically in FIGS. 3 and 4.

In the rotatable transfer mechanism B, the planetary gear trains rotate along the outer periphery of the fixed gear, whereby the suction cups $B_1$ are each moved along a hypotrochoid path. With regard to each suction cup $B_1$, suction is begun before it passes between the upper and lower stoppers 3 and 4. The carton A positioned at the downstream end is engaged by the suction of a suction cup $B_1$ while being slightly pushed back due to the movement of the transfer mechanism, and is then withdrawn from the magazine by means of the suction cup $B_1$, which cup then moves downwardly and brings the carton into pressure contact with a fixed inclined guide C to open the carton squarely. Thereafter, the suction is discontinued.

The operation of the magazine thus constructed will now be more fully explained. First, in an initial state, the upper and lower edges $A_1$ and $A_2$ of the carton A positioned at the downstream end strike the upper and lower stoppers 3 and 4, respectively, so that the sliding motion of the downstream side is stopped, while the pressure from the upstream side is received by the cartons A' whose upper and lower edges $A_1'$ and $A_2'$ are held in pressure contact with the circumferential surfaces of the feed rollers 5 and the surface 1*a* of the upper guide, whereby the cartons A positioned downstream of the cartons A, are movably held within the respective ranges of elasticity of the folded cartons therein.

A suction cup $B_1$ moving along the hypotrochoid path of the transfer mechanism B comes into contact with carton A located at the downstream end and pushes it back toward the upstream side. In response to the pushing back of the most downstream carton, the cartons A positioned downstream of the feed rollers 5 are compressed and slide toward the upstream side. The carton A at the downstream end then moves, following the suction cup $B_1$ and is begun to be withdrawn toward the downstream side by the suction cup $B_1$.

At this time, as the suction cup $B_1$ begins to withdraw the carton A, the upper and lower edges $A_1$ and $A_2$ of the most downstream carton are brought into sliding contact with the curved inner end faces 3*a* and 4*a*, or inclined faces, of the upper and lower stoppers 3 and 4, and are thereby gradually compressed in a direction toward each other and, thus, the carton begins to open.

Simultaneously, a rear edge $A_3$ of the carton A moves toward the upstream side, although this movement is also absorbed by compression and the upstream slide of the cartons A positioned downstream of the feed rollers 5.

When the most downstream carton A has been withdrawn completely, the next carton adjacent thereto slides downstream until stopped by the upper and lower stoppers 3 and 4, whereupon the cartons positioned downstream of the feed rollers 5 also slide downstream successively.

When the carton withdrawal operation is repeated several times, the cartons positioned downstream of the feed rollers 5 tilt and their upper edges $A_1''$ become lower. The drive-controlling sensor 9 detects this condition and drives the motor 8 to rotate the feed rollers 5, whereby the cartons A positioned upstream of the feed rollers 5 are delivered to the downstream side at a higher speed than the carton withdrawing speed of the suction cup $B_1$.

In synchronism therewith the conveyor belts 10*c*, which constitute the conveyance portion 10 for supplying a large quantity of cartons, operate to replenish the cartons A to the upstream side of the feed rollers 5.

As a result, the number of cartons A on the downstream side of the feed rollers 5 gradually increases and the cartons A" positioned downstream of the rollers assume their upright positions so that their upper edges $A_1''$ rise. This change in position is detected by the sensor 9, which stops the operation of the motor 8 to discontinue the carton feeding operation of the feed rollers 5 and the conveyor belts 10*c*.

Thereafter, the above operations are repeated with regard to a successive carton.

Right and left end faces of each carton A are guided by a pair of right and left guide walls 11 as shown, e.g., in FIG. 2. The right and left guide walls 11 and the upper and lower guides 1, 2 are so constructed as to be adjustable in size or movably adjustable according to the sizes of cartons A. For example, guides 1, 2, and 11 can be adjustably mounted for movement toward and away from the supply channel of the magazine.

Figure 5:
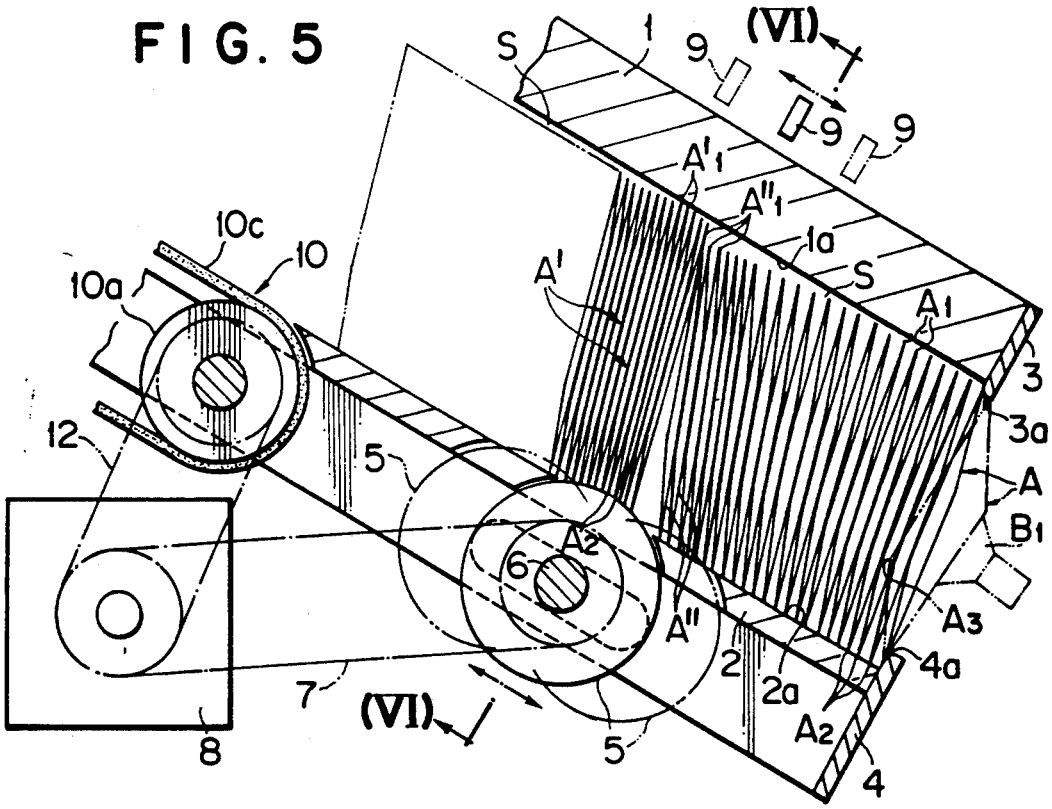
FIG. 5 is a partial longitudinal sectional, side view of a magazine according to another embodiment of the present invention.
Figure 6:
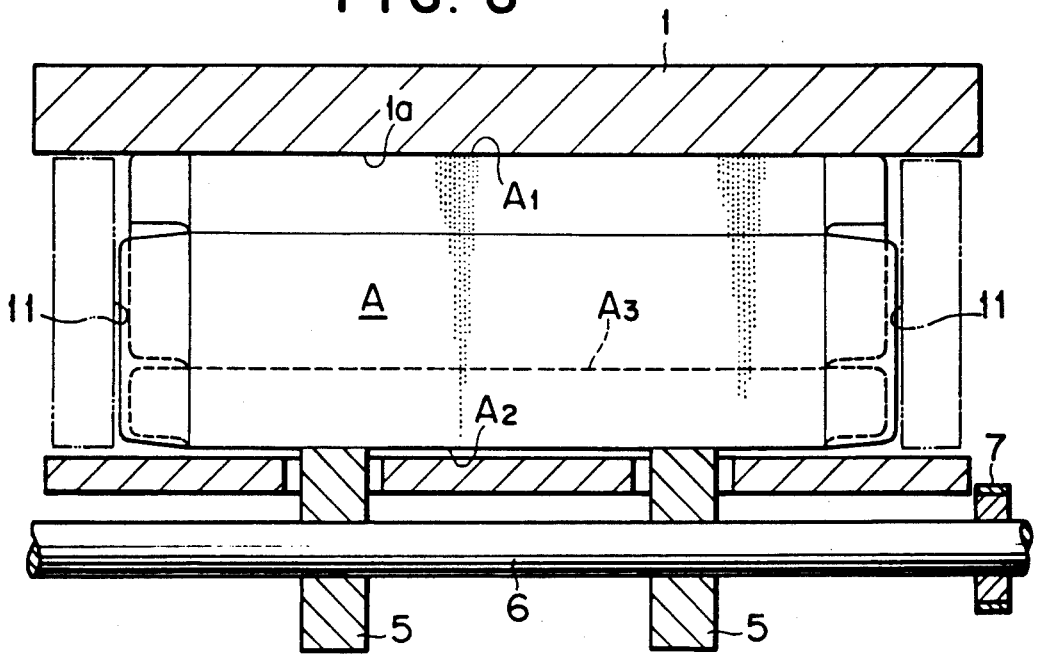
FIG. 6 a sectional view taken along line (VI)-(VI) of FIG. 5.

FIGS. 5 and 6 show another embodiment, wherein the feed rollers 5 are movable in the stacked direction of cartons A along the supply channel, and the drive-controlling sensor 9 is also made correspondingly movable. Conventional means can be used for removably affixing the rollers 5 and sensor 9, respectively, to portions of the apparatus.

Further, the driving pulleys 10*a* of the conveyance portion 10 for supplying a large quantity of cartons are supported by a shaft separate from the rotary shaft 6 and connected to the motor 8 through a transfer belt 12.

Consequently, the number of cartons A held between the feed rollers 5 and the upper and lower stoppers 3, 4 is adjustable to adjust the pressure to be imposed on the carton A positioned at the downstream end according to the material, size, paper thickness, and shape of cartons A, or the state and duration of storage of cartons A, thereby permitting the cartons to be withdrawn exactly in a half-opened condition.

The present invention, as described above, has the following advantages.

Both edges of the carton positioned at the downstream end are retained by both stoppers and stop sliding, while on the upstream side both edges of a carton are held in pressure contact with the surfaces of the feed rollers and the inner surface of one guide, thereby allowing the said carton to serve as a shutoff to prevent the upstream-side pressure from being exerted on the downstream cartons. In this way, not only is a free elasticity of the cartons retained, but also a push-back operation is smoothly performed for the successive cartons induced by the opening tendency of each carton, involving expansion in the carton stacked direction when the carton is withdrawn by the suction cup or other withdrawal device. As a result, the backward inclination of the cartons due to the tilting and the lessening of the pressure of the stacked cartons is facilitated and the cartons are withdrawn successively from the one positioned at the downstream end. Then, upon detection by the sensor of a decrease in the number of cartons positioned downstream of the feed rollers, the rollers are operated to push the cartons upwardly into abutment with the inner surface of the upper guide while intermittently replenishing the shortage. Therefore, even in the event of the occurrence of slight variations in the vertical width of cartons, it is possible to completely prevent jamming and dropping of cartons. Further, the movement of the cartons located downstream of the rollers can be done smoothly by isolating those cartons from upstream pressure.

Accordingly, as compared with the conventional magazine which does not operate properly unless cartons are made uniform in their vertical width, it is easier to effect the quality control for cartons, and material costs can be reduced. Further, the suction time of the suction cup can be made longer to ensure the suction as compared with the conventional magazine, wherein resistance is developed during the push-back of the cartons during suction.

When the downstream end carton is withdrawn from between the upper and lowers stoppers by virtue of the suction engagement with the suction cup, both upper and lower edges of the carton are brought into sliding contact with the curved or inclined end faces of the stoppers and are thereby compressed toward each other. That is, the sliding contact motion of the carton is converted to an opening action tending to expand the carton in the stacked direction, thus permitting the carton to be partially opened as it is drawn out.

Consequently, fully square opening is ensured as compared with the conventional magazine in which the carton is drawn out in a compressed state.

The conveyance portion for supplying a large quantity of cartons is operated in synchronism with the feed of cartons by the feed rollers, whereby cartons in the same quantity as those fed by the feed rollers are replenished to the upstream side of the feed rollers, so that the replenishment of cartons can be ensured without functional deterioration of the conveyance portion, even when the same portion changes in its angle from horizontal to vertical or vertically inclined.

Therefore, in comparison with the conventional magazine, wherein cartons are replenished into the magazine through a horizontal conveyor, the conveyance portion for supplying a large quantity of cartons can be disposed according to the particular configuration of the installation site.

Since the number of cartons held between the feed rollers and the downstream end of the magazine can be increased or decreased by adjusting the position of the feed rollers in the stacked direction of the cartons, it is possible to select the most suitable pressure to be applied to the downstream end carton according to the material, size, paper thickness, and shape of the cartons, or the state and duration of storage of the cartons.

Thus, the magazine of the present invention can cope with all kinds of cartons, whereas conventional magazines can cope with only a limited variety of cartons.

Although the invention has been disclosed as utilizing particular means, elements, and structural details, the invention is not to be limited thereto, but extends to all equivalents embraced by the claims as set forth below. For example, in the rotatable transfer mechanism B described in the above embodiments, three planetary gear trains are engaged with a fixed gear, and suction cups $B_1$ each move along a hypotrochoid path. However, the invention is not limited to a transfer mechanism of this construction in which the cartons are withdrawn in their stacked direction by means of suction cups. It is to be understood that a linear mechanism or other known means may, alternatively, be adopted.

Further, although the upper and lower guides 1 and 2 are shown to be inclined at an angle of about 30 degrees, this is not to be understood to be a limitation. Further, although a diffuse reflection type photoelectric sensor is described herein as the drive-controlling sensor 9, any other means detecting a decrease in the number of cartons can be utilized. Its mounting position may be changed accordingly.

What is claimed is:

1. A magazine for holding a plurality of stacked, flatwise folded cartons which are to be singularly withdrawn therefrom at a downstream end thereof, said magazine comprising:

an upper guide and a lower guide, generally parallel to said upper guide, each of said upper guide and said lower guide having a respective inner surface between which said stacked cartons are held, said upper guide and said lower guide being spaced apart by a distance greater than a given distance between a pair of edges of respective cartons in their flatwise folded condition, thereby creating a gap between one of said upper and lower guides and one of said pair of edges of respective cartons;

an upper stopper projecting from said upper guide surface and a lower stopper projecting from said lower guide surface, said upper stopper and said lower stopper being spaced apart by a distance less than said given distance between said pair of edges of said respective cartons;

at least one feed roller, at least a portion of which projects from said lower guide surface toward said upper guide surface and is spaced from said upper guide surface by a distance less than said given distance between said pair of edges of said respective cartons;

means for driving said at least one feed roller for rotation toward said downstream end of said magazine; and a sensor operatively associated with said driving means for controlling said rotation of said at least one feed roller as a function of the quantity of cartons positioned downstream of said at least one feed roller.

2. A magazine according to claim 1, wherein each of said stoppers has a curved or inclined inner end face such that a spacing is defined between said inner end face of said first stopper and said inner end face of said second stopper which gradually decreases toward said downstream end of said magazine.

3. A magazine according to claim 1, further comprising a supply conveyor having a conveyance portion disposed upstream of said lower guide surface for supplying a plurality of cartons, wherein said conveyance portion is adapted to be driven in synchronism with said at least one feed roller.

4. A magazine according to claim 1, wherein said feed roller is mounted for selective adjustment toward and away from said downstream end of said magazine.

5. An apparatus for storing articles in a supply and for facilitating withdrawal of said articles from said supply, said apparatus comprising:

(a) means for guiding said articles for movement from an upstream position to a downstream position comprising at least two guide surfaces, one of said two guide surfaces supporting at least a portion of the weight of said articles thereupon;

(b) a discharge end located at the most downstream portion of said guiding means from which said articles can be withdrawn from said supply;

(c) means located along said guiding means, upstream of said discharge end, for substantially isolating a first predetermined number of said articles in said supply from the pressure created by a second predetermined number of said articles positioned upstream of said first predetermined number of said articles, to expose said articles in said first predetermined number of said articles to less pressure from adjacent ones of said articles in said first predetermined number of articles than said pressure crated by said second predetermined number of said articles, positioned upstream of said first predetermined number of articles, wherein said means for isolating comprises means for engaging and advancing at least one of said articles in said supply, said means for engaging and advancing being positioned proximate one of said at least two guide surfaces and at least partially projects from said open of said at least two guide surfaces toward a second of said at least two guide surfaces to be spaced from said second guide surface by a distance less than a predetermined width dimension of one of said articles, wherein said at least two guide surfaces comprise a lower guide surface upon which a plurality of said articles within said supply are to be supported, and an upper guide surface adapted to be spaced from said lower guide surface at a distance greater than a predetermined width dimension of at least one of said articles, to thereby create a gap between said at least one of said articles and said upper guide surface at least at said downstream portion of said guiding means.

6. The apparatus of claim 5 wherein said guiding means comprises at least two substantially parallel guide surfaces.

7. The apparatus of claim 5 wherein said means for isolating comprises means for temporarily engaging at least one of said articles in said supply.

8. The apparatus of claim 5 wherein said means for isolating comprises means for temporarily engaging and advancing at least one of said articles in said supply towards said discharge end of said supply.

9. The apparatus of claim 8 wherein said means for temporarily engaging and advancing comprises an intermittently driven roller.

10. The apparatus of claim 9 wherein said roller is mounted for selective adjustment toward and away from said discharge end of said supply.

11. The apparatus of claim 5 wherein said means for guiding comprises at least two guide surfaces which are each inclined downwardly toward said discharge end at a predetermined angle from horizontal.

12. The apparatus of claim 11 wherein said predetermined angle is approximately 30 degrees.

13. The apparatus of claim 11 wherein said means for guiding comprises at least one guide surface, wherein said apparatus further comprises a supply conveyor positioned proximate an upstream portion of said one guide surface for supplying said articles thereto and having a reach adjacent said upstream portion of said one guide surface and which is inclined substantially at said predetermined angle.

14. The apparatus of claim 5 wherein said first predetermined number of said articles extend from a position adjacent said discharge end, and wherein said apparatus further comprises means for controlling the value of said first predetermined number of articles.

15. The apparatus of claim 14 wherein said means for isolating comprises means for intermittently feeding said articles toward said discharge end, Wherein said means for controlling comprises means for sensing a condition indicative of said value of said first predetermined number of articles and means for driving said means for intermittently feeding said articles.

16. The apparatus of claim 15 wherein said means for guiding comprises at least a lower guide surface for supporting said articles and an upper guide surface and wherein said condition sensed by said means for sensing is a function of a space between said upper guide surface and at least one article not engaged by said means for isolating said first predetermined number of articles.

17. The apparatus of claim 5 wherein said articles are flatwise folded cartons and wherein said means for isolating a first predetermined number of said articles further comprises means for at least partially opening said folded cartons.

18. The apparatus of claim 5 wherein said articles are flatwise folded cartons and wherein said apparatus further comprises means for facilitating at least partial opening of said folded cartons.

19. The apparatus of claim 18 wherein said means for facilitating at least partial opening of said folded cartons comprises at least a first projection proximate said discharge end, projecting from one of said at least two guide surfaces and a second projection proximate said discharge end, projecting from a second of said at least two guide surfaces.

20. The apparatus of claim 19 wherein said first projection and said second projection are spaced apart by a distance less than a width dimension of at least one of said cartons such that, upon engagement of a first portion of a respective carton at said discharge end by a withdrawal mechanism for withdrawing said respective carton from said supply, second and third opposed portions of said carton engage respective portions of said first and second projections to thereby enable said respective carton to be at least partially opened.

21. The apparatus of claim 20 further comprising said withdrawal mechanism for engagement with said first portion of a respective carton.

22. The apparatus of claim 21 wherein said withdrawal mechanism comprises at least one vacuum device for engaging said first portion of a respective article.

23. The apparatus of claim 19 wherein said first projection and said second projection comprise respective surfaces which converge toward said discharge end of said apparatus.

24. The apparatus of claim 23 wherein said respective surfaces are substantially planar.

25. The apparatus of claim 23 wherein said respective surfaces are curved.

26. The apparatus of claim 5 wherein said means for engaging and advancing advances said articles along said means for guiding toward said discharge end, wherein said apparatus further comprises a supply conveyor having a reach upstream from and adjacent to said means for guiding, and means for synchronously driving said supply conveyor and said means for advancing said articles.

27. The apparatus of claim 26 wherein said means for engaging and advancing comprises at least one feed roller, wherein said supply conveyor comprises at least one endless conveyor belt.

28. The apparatus of claim 27 wherein said at least one endless conveyor belt comprises a driven shaft upon which said at least one feed roller is mounted for driven engagement thereby.

29. The apparatus of claim 15 wherein said upper guide surface generally extends in a place which is positioned above a plane in which said lower surface generally extends.

30. A method of feeding flatwise folded cartons, each having a predetermined width, through a magazine, from an upstream portion to a downstream portion, and of facilitating withdrawal of said cartons from said magazine comprising:

(a) creating a supply of stacked cartons within said magazine;

(b) guiding said folded cartons within said magazine between an upstream position to a downstream end by means of at least a pair of substantially parallel guide surfaces spaced apart by a distance greater than said predetermined width of said cartons to thereby define a gap between a first edge of each of said stacked cartons and one of said guide surfaces, at least at said downstream portion of said magazine; and (c) engaging a respective second edge of at least one of said cartons within said magazine and moving said at least one of said cartons toward and against a second of said guide surfaces to thereby isolate a downstream quantity of cartons from the weight of an upstream quantity of cartons.

31. The method of claim 30 further comprising the steps of sensing a reduction in said second downstream quantity of cartons; feeding said at least one of said cartons, previously engaged and pushed, and feeding an additional quantity of cartons maintained in said magazine toward said downstream end; and engaging a respective second edge of at least a second one of said cartons within said magazine and moving said at least a second one of said cartons toward and against said second of said guide surfaces to thereby isolate a second upstream quantity of cartons from a second downstream quantity of cartons to thereby substantially maintain a predetermined downstream quantity of stacked cartons proximate said downstream end.

32. The method of claim 30 further comprising the steps of restricting downstream movement of at least a first edge and an opposed second edge of the most downstream carton which is proximate said downstream end of said magazine; and withdrawing said most downstream carton by engaging a portion of said most downstream carton between said first edge and said second edge to thereby at least partially open said most downstream carton as it is withdrawn from said magazine.

33. The method of claim 30 wherein said magazine has a discharge end and wherein said downstream portion of said magazine is adjacent said discharge end.

34. An apparatus for storing articles in a supply and for facilitating withdrawal of said articles from said supply, said apparatus comprising:

(a) means for guiding said articles for movement from an upstream position to a downstream position comprising at least two spaced apart guide surfacers having respective upstream portions and downstream portions;

(b) a discharge end located at the most downstream portion of said guiding means from which said articles can be withdrawn from said supply, said two guide surfaces being spaced apart, at least at said discharge end, by a distance greater than a predetermined width dimension of one of said articles to thereby create a gap between one of said two guide surfaces and a first respective edge of said cartons; and (c) means located along a second of said two guide surfaces, upstream of said discharge end, for substantially isolating a first predetermined number of said articles in said supply from the pressure created by a second predetermined number of said articles positioned upstream of said first predetermined number of said articles by engaging and moving at least a respective second edge of at least one of said articles toward and against a second of said guide surfaces.

35. An apparatus for storing articles in a supply and for facilitating withdrawal of said articles from said supply, said apparatus comprising:

(a) means for guiding said articles for movement from an upstream position to a downstream position;

(b) a discharge end located at the most downstream portion of said guiding means from which said articles can be withdrawn from said supply;

(c) means located along said guiding means, upstream of said discharge end, for substantially isolating a first predetermined number of said articles in said supply from the pressure created by a second predetermined number of said articles positioned upstream of said first predetermined number of said articles, and for causing respective upper portions of said first predetermined number of said articles to lean toward said second predetermined number of said articles .

36. The apparatus of claim 35 wherein said guiding means comprises at least two spaced apart guide surfaces and wherein said isolating means comprises a device mounted proximate one of said two guide surfaces, wherein said first predetermined number of said articles in said supply are free from engagement with another of said two guide surfaces.

37. The apparatus of claim 36 wherein said two guide surfaces are spaced apart, at least at said discharge end of said supply, by a distance greater than a predetermined width dimension of one of said articles.

38. The apparatus of claim 37 wherein said isolating means comprises a member for engaging a portion of successive ones of said articles in said supply, said member projecting from said one of said two guide surfaces toward said another of said two guide surfaces to be spaced from said another of said two guide surfaces by a distance less than said predetermined width dimension of one of said articles.

* * * * *

UNITED STATES PATENT AND TRADEMARK OFFICE

CERTIFICATE OF CORRECTION

PATENT NO. : 5,057,066

DATED : October 15, 1991

INVENTOR(S) : Toshio NAGAHASHI et al.

It is certified that error appears in the above-identified patent and that said Letters Patent is hereby corrected as shown below:

On the title page: , item [56] of the printed patent, insert ---59-26833 2/1984 Japan---.

At column 1, line 27 of the printed patent, change "flapengaging" to ---flap-engaging---.

At column 1, line 62 of the printed patent, change "int he" to ---in the---.

At column 3, line 34 of the printed patent, change "firsts" to ---first---.

At column 3, line 47 of the printed patent, change "mean" to ---means---.

At column 4, line 23 of the printed patent, change "that" to ---than---.

At column 6, line 58 of the printed patent, change "section" to ---suction---.

At column 7, line 25 of the printed patent, change "section" to ---suction---.

At column 9, line 9 of the printed patent, change "section" to ---suction---.

At column 13, line 15 (claim 5, line 21) of the printed patent, change "crated" to ---created---.

UNITED STATES PATENT AND TRADEMARK OFFICE

CERTIFICATE OF CORRECTION

PATENT NO. : 5,057,066

DATED : October 15, 1991

INVENTOR(S) : Toshio Nagahashi, et al

It is certified that error appears in the above-indentified patent and that said Letters Patent is hereby corrected as shown below:

Column 14, line 8 (claim 15, line 3) change "Wherein" to --wherein--

Signed and Sealed this

Eighth Day of June, 1993

*Attest:*

Michael K. Kirk

MICHAEL K. KIRK

*Attesting Officer*

*Acting Commissioner of Patents and Trademarks*